US006369771B1

(12) United States Patent
Chiang et al.

(10) Patent No.: US 6,369,771 B1
(45) Date of Patent: Apr. 9, 2002

(54) LOW PROFILE DIPOLE ANTENNA FOR USE IN WIRELESS COMMUNICATIONS SYSTEMS

(75) Inventors: Bing Chiang, Melbourne; Kenneth M. Gainey; Griffin K. Gothard, both of Satellite Beach; Christopher A. Snyder, Palm Bay, all of FL (US)

(73) Assignee: Tantivy Communications, Inc., Melbourne, FL (US)

( * ) Notice: Subject to any disclaimer, the term of this patent is extended or adjusted under 35 U.S.C. 154(b) by 0 days.

(21) Appl. No.: 09/773,377

(22) Filed: Jan. 31, 2001

(51) Int. Cl.[7] ..... H01Q 9/28

(52) U.S. Cl. ..... 343/795; 343/700 MS; 343/820; 343/821; 343/829

(58) Field of Search ..... 343/700 MS, 702, 343/793, 795, 799, 802, 810, 814, 820, 821, 829, 846, 830, 853

(56) References Cited

U.S. PATENT DOCUMENTS 4,001,834 A * 1/1977 Smith ..... 343/754
4,125,839 A 11/1978 Kaloi ..... 343/700
4,471,493 A 9/1984 Schober ..... 455/90

(List continued on next page.)

*Primary Examiner*—Tho Phan

(74) *Attorney, Agent, or Firm*—Hamilton, Brook, Smith & Reynolds, P.C.

(57) ABSTRACT

A dipole antenna for use with a mobile subscriber unit in a wireless network communications system. The antenna is fabricated with printed circuit board (PCB) photo-etching techniques for precise control of the printed structure. The dipole antenna includes a planar substrate made of dielectric material. A conductive planar element is layered on one side of the substrate in an upper region of the substrate, and a conductive planar ground patch is layered on the other side of the substrate in a lower region of the substrate. That is, the conductive planar element is stacked above the conductive planar ground patch. A feed strip is connected to the bottom of the conductive planar element, and extends from the element to a bottom edge of the substrate and terminates at a bottom feed point. Typically, the feed point is connected to a transmission line for transmitting signals to and receiving signals from the dipole antenna. The conductive planar ground patch includes a bottom end for connecting the ground patch to a ground plane upon which the dipole antenna is mounted. The ground plane is aligned orthonormal to the antenna. Capacitive coupling between the conductive planar element and the conductive ground patch creates a junction which provides an upper dipole feed point in a mid-region of the substrate such that the conductive planar element acts as one element of an unbalanced dipole antenna and the conductive planar ground patch acts as the other element of the unbalanced dipole antenna. The unbalanced dipole antenna forms a beam which may be positionally directed along a horizon that is substantially parallel to the ground plane.

24 Claims, 8 Drawing Sheets

U.S. PATENT DOCUMENTS

| | | | | | |
|---|---|---|---|---|---|
| 4,475,111 | A | | 10/1984 | Gittinger et al. | 343/881 |
| 4,608,572 | A | | 8/1986 | Blakney et al. | 343/792.5 |
| 4,827,271 | A | | 5/1989 | Berneking et al. | 343/700 |
| 4,853,704 | A | | 8/1989 | Diaz et al. | 343/767 |
| 5,010,349 | A | | 4/1991 | Mizuno et al. | 343/700 |
| 5,121,127 | A | | 6/1992 | Toriyama | 343/700 |
| 5,210,542 | A | | 5/1993 | Pett et al. | 343/700 |
| 5,216,430 | A | | 6/1993 | Rahm et al. | 343/700 |
| 5,245,349 | A | | 9/1993 | Harada | 343/700 |
| 5,268,701 | A | * | 12/1993 | Smith | 343/767 |
| 5,400,040 | A | | 3/1995 | Lane et al. | 343/700 |
| 5,434,575 | A | | 7/1995 | Jelinek et al. | 342/365 |
| 5,442,366 | A | | 8/1995 | Sanford | 343/700 |
| 5,519,408 | A | | 5/1996 | Schnetzer | 343/767 |
| 5,990,836 | A | | 11/1999 | Bhattacharyya | 343/700 |
| 5,995,048 | A | | 11/1999 | Smithgall et al. | 343/700 |
| 6,094,177 | A | | 7/2000 | Yamamoto | 343/806 |
| 6,100,855 | A | | 8/2000 | Vinson et al. | 343/846 |
| 6,107,967 | A | * | 8/2000 | Hill | 343/702 |
| 6,111,552 | A | | 8/2000 | Gasser | 343/873 |
| 6,114,996 | A | | 9/2000 | Nghiem | 343/700 |
| 6,121,932 | A | | 9/2000 | McCoy et al. | 343/700 |
| 6,140,965 | A | | 10/2000 | Van Hoozen | 343/700 |
| 6,160,515 | A | * | 12/2000 | McCoy et al. | 343/702 |
| 6,211,840 | B1 | * | 4/2001 | Wood et al. | 343/793 |
| 6,275,192 | B1 | * | 8/2001 | Kim | 343/700 MS |

* cited by examiner

LOW PROFILE DIPOLE ANTENNA FOR USE IN WIRELESS COMMUNICATIONS SYSTEMS

BACKGROUND OF THE INVENTION

Code Division Multiple Access (CDMA) communication systems may be used to provide wireless communication between a base station and one or more subscriber units. The base station is typically a computer controlled set of switching transceivers that are interconnected to a land-based public switched telephone network (PSTN). The base station includes an antenna apparatus for sending forward link radio frequency signals to the mobile subscriber units. The base station antenna is also responsible for receiving reverse link radio frequency signals transmitted from each mobile unit. Each mobile subscriber unit also contains an antenna apparatus for the reception of the forward link signals and for transmission of the reverse link signals. A typical mobile subscriber unit is a digital cellular telephone handset or a personal computer coupled to a wireless cellular modem.

The most common type of antenna used to transmit and receive signals at a mobile subscriber unit is a omnidirectional monopole antenna. This type of antenna consists of a single wire or antenna element that is coupled to a transceiver within the subscriber unit. The transceiver receives reverse link signals to be transmitted from circuitry within the subscriber unit and modulates the signals onto the antenna element at a specified frequency assigned to that subscriber unit. Forward link signals received by the antenna element at a specified frequency are demodulated by the transceiver and supplied to processing circuitry within the subscriber unit. In CDMA cellular systems, multiple mobile subscriber units may transmit and receive signals on the same frequency and use coding algorithms to detect signaling information intended for individual subscriber units on a per unit basis.

The transmitted signal sent from a monopole antenna is omnidirectional in nature. That is, the signal is sent with the same signal strength in all directions in a generally horizontal plane. Reception of signals with a monopole antenna element is likewise omnidirectional. A monopole antenna does not differentiate in its ability to detect a signal on one direction versus detection of the same or a different signal coming from another direction.

SUMMARY OF THE INVENTION

Various problems are inherent in prior art antennas used on mobile subscriber units in wireless communications systems. Typically, an antenna array with scanning capabilities consists of a number of antenna elements located on top of a ground plane. For the subscriber unit to satisfy portability requirements, the ground plane must be physically small. For example, in cellular communication applications, the ground plane is typically smaller than the wavelength of the transmitted and received signals. Because of the interaction between the small ground plane and the antenna elements, which are typically monopole elements, the peak strength of the beam formed by the array is elevated above the horizon, for example, by about 30°, even though the beam itself is directed along the horizon. Correspondingly the strength of the beam along the horizon is about 3 db less than the peak strength. Generally, the subscriber units are located at large distances from the base stations such that the angle of incidence between the subscriber unit and the base station is approximately zero. The ground plane would have to be significantly larger than the wavelength of the transmitted/received signals to be able to bring the peak beam down towards the horizon. For example, in an 800 Mhz system, the ground plane would have to be significantly larger than 14 inches in diameter,and in a PCS system operating at about 1900 Mhz, the ground plane would have to be significantly larger than about 6.5 inches in diameter. Ground planes with such large sizes would prohibit using the subscriber unit as a portable device. Since the antenna array is intended for portable applications, a small size array, for example, an array having a reduced height is highly desirable. Further, it is desirable to produce antenna elements with these beam directing features using low-cost mass production techniques.

The present invention greatly reduces problems encountered by the aforementioned prior art antenna systems. The present invention provides an inexpensive low profile dipole antenna for use with a mobile subscriber unit in a wireless same frequency network communications system, such as CDMA cellular communication networks. The antenna is fabricated with printed circuit board (PCB) photo-etching techniques for precise control of the printed structure. The design includes a two solid conductive patches with a very short feed line so that its conductive loss is minimal.

In one aspect of the invention, the dipole antenna includes a planar substrate made of dielectric material. A conductive planar element is layered on one side of the substrate, and a conductive planar ground patch is layered on the other side of the substrate. The conductive planar element is located in an upper region of the substrate, while the conductive planar ground patch is offset from the conductive planar element in lower region of the substrate. That is, the conductive planar element is stacked above the conductive planar ground patch. A feed strip is connected to the bottom of the conductive planar element, and extends from the element to a bottom edge of the substrate and terminates at a bottom feed point. Typically, the feed point is connected to a transmission line for transmitting signals to and receiving signals from the dipole antenna. The conductive planar ground patch includes a bottom end for connecting the ground patch to a ground plane upon which the dipole antenna is mounted. The ground plane is aligned orthonormal to the antenna.

Capacitive coupling between the conductive planar element and the conductive ground patch creates a junction which provides an upper dipole feed point in a midregion of the substrate such that the conductive planar element acts as one element of an unbalanced dipole antenna and the conductive planar ground patch acts as the other element of the unbalanced dipole antenna. The unbalanced dipole antenna forms a beam which may be positionally directed along a horizon that is substantially parallel to the ground plane.

Embodiments of this aspect can include one or more of the following features. The bottom edge of the conductive planar element and the top edge of the conductive planar ground patch define a gap. The width of the gap can be varied to alter the capacitance of the dipole antenna. The feed strip includes an upward extension positioned between a pair of notches at the bottom edge of the conductive planar element, and the conductive planar ground patch includes a snub located in the middle of the top edge of the ground patch. As such, the interaction between the upward extension, the pair of notches, and the snub provides a short-circuited coplanar waveguide. The length and/or the width of the notches can be varied to alter the inductance of the dipole antenna.

Typically, the conductive planar element and the conductive planar ground patch have rectangular shapes with the shorter sides of the element and the ground patch being aligned perpendicular to the bottom edge of the substrate. The width of the conductive planar element and the width of the conductive planar ground patch are sufficient to provide broadband performance. Even though the antenna acts as a half-wave dipole antenna, the height of the conductive planar element and the height of the conductive planar ground patch are reduced to at least a one-sixth wavelength.

The dielectric substrate can be made from, for example, PCB materials such as polystyrene or Teflon. The conductive planar element, the feed strip, and the conductive planar ground patch are usually made from copper.

In a certain embodiment of this aspect, the conductive planar element is connected to a phase shifter. The phase shifter is independently adjustable to affect the phase of a respective signal transmitted from the dipole antenna. Alternatively, the planar element is connected to a delay line. The antenna can be connected to variable or lumped impedance element and/or a switch. Ideally, the peak strength of the directed beam rises no more than about 10° above the horizon.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1A:
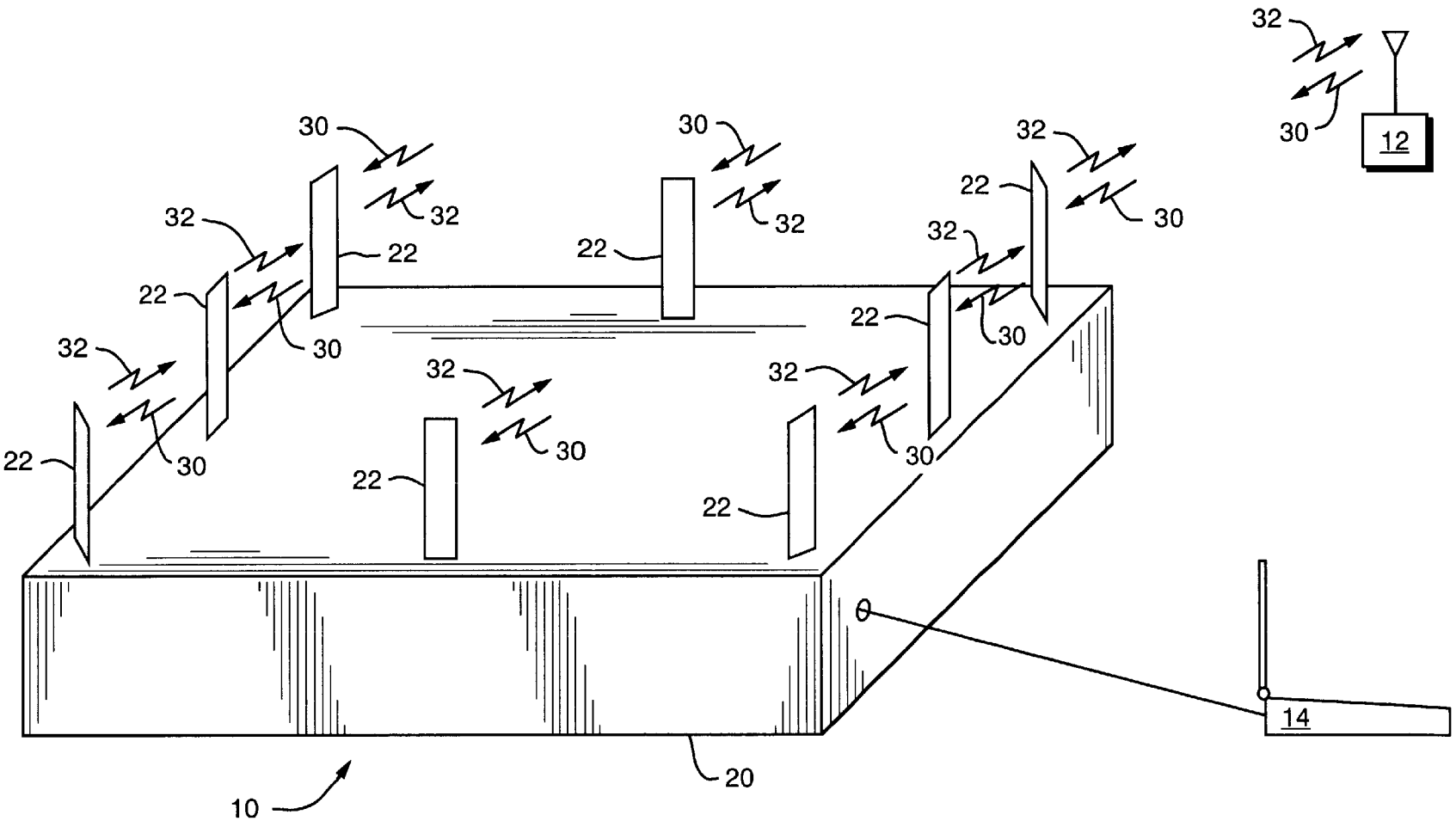
FIG. 1A illustrates a preferred configuration of an antenna apparatus used by a mobile subscriber unit in a cellular system according to this invention.

A description of preferred embodiments of the invention follows. Turning now to the drawings, there is shown in FIG. 1A an antenna apparatus 10 configured according to the present invention. Antenna apparatus 10 serves as the means by which transmission and reception of radio signals is accomplished by a subscriber unit, such as a laptop computer 14 coupled to a wireless cellular modem, with a base station 12. The subscriber unit provides wireless data and/or voice services and can connect devices such as the laptop computer 14, or personal digital assistants (PDAs) or the like through the base station 12 to a network which can be a Public Switched Telephone Network (STN), a packet switched computer network, or other data network such as the Internet or a private intranet. The base station 12 may communicate with the network over any number of different efficient communication protocols such as primary ISDN, or even TCP/IP if the network is an Ethernet network such as the Internet. The subscriber unit may be mobile in nature and may travel from one location to another while communicating with base station 12.

It is also to be understood by those skilled in the art that FIG. 1 may be a standard cellular type communication system such as CDMA, TDMA, GSM or other systems in which the radio channels are assigned to carry data and/or voice signals between the base station 12 and the subscriber unit 14. In a preferred embodiment, FIG. 1 is a CDMA-like system, using code division multiplexing principles such as those defined in U.S. Pat. No. 6,151,332.

Antenna apparatus 10 includes a base or ground plane 20 upon which are mounted eight antenna elements 22. As illustrated, the antenna apparatus 10 is coupled to the laptop computer 14 (not drawn to scale). The antenna apparatus 10 allows the laptop computer 14 to perform wireless communications via forward link signals 30 transmitted from the base station 12 and reverse link signals 32 transmitted to the base station 12.

In a preferred embodiment, each antenna element 22 is disposed on the ground plane 20 in the dispersed manner as illustrated in the figure. That is, a preferred embodiment includes four elements which are respectively positioned at locations corresponding to corners of a square, and four additional elements, each being positioned along the sides of the square between respective corner elements.

Figure 2A:
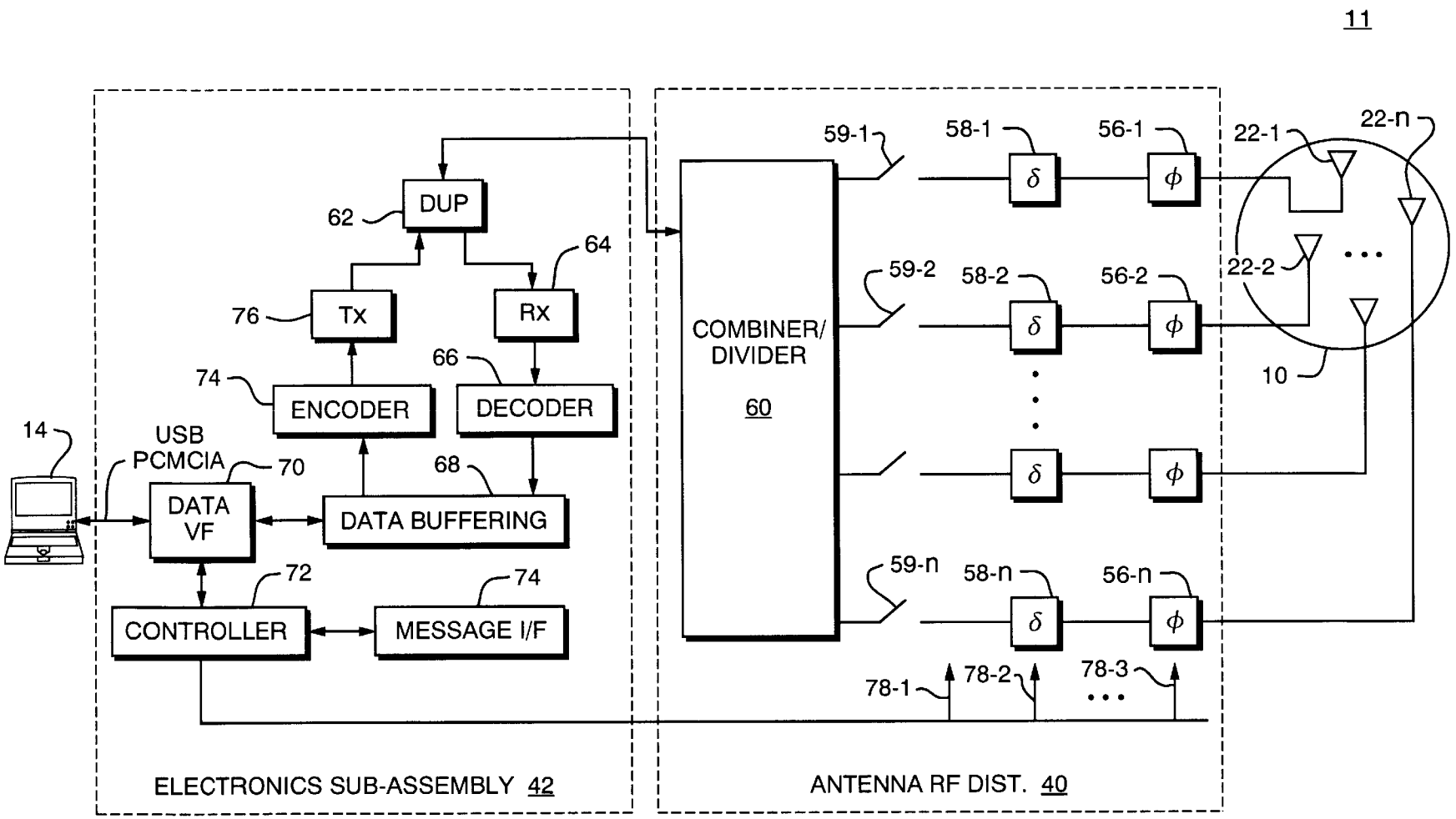
FIG. 2A is a system level diagram for the electronics used to control the antenna array of FIG. 1A.

Turning attention to FIG. 2A, there is shown a block diagram of the electronics which control the subscriber access unit 11. The subscriber access unit 11 includes the antenna array 10, antenna Radio Frequency (RF) subassembly 40, and an electronics sub-assembly 42. Wireless signals arriving from the base station 12 are first received at the antenna array 10 which consists of the antenna elements 22-1, 22-2, . . . , 22-N. The signals arriving at each antenna element are fed to the RF subassembly 40, including, for example, a phase shifter 56, delay 58, and/or switch 59. There is an associated phase shifter 56, delay 58, and/or switch 59 associated with each antenna element 22.

The signals are then fed through a combiner divider network 60 which typically adds the energy in each signal chain providing the summed signal to the electronics subassembly 42.

In the transmit direction, radio frequency signals provided by the electronic subassembly 42 are fed to the combiner divider network 60. The signals to be transmitted follow through the signal chain, including the switch 59, delay 58, and/or phase shifter 56 to a respective one of the antenna elements 22, and from there are transmitted back towards the base station.

In the receive direction, the electronics sub-assembly 42 receives the radio signal at the duplexer filter 62 which provides the received signals to the receiver 64. The radio receiver 64 provides a demodulated signal to a decoder circuit 66 that removes the modulation coding. For example, such decoder may operate to remove Code Division Multiple Access (CDMA) type encoding which may involve the use of pseudorandom codes and/or Walsh codes to separate the various signals intended for particular subscriber units, in a manner which is known in the art. The decoded signal is then fed to a data buffering circuit 68 which then feeds the decoded signal to a data interface circuit 70. The interface circuit 70 may then provide the data signals to a typical computer interface such as may be provided by a Universal Serial Bus (USB), PCMCIA type interface, serial interface or other well-known computer interface that is compatible with the laptop computer 14. A controller 72 may receive and/or transmit messages from the data interface to and from a message interface circuit 74 to control the operation of the decoder 66, an encoder 74, the tuning of the transmitter 76 and receiver 64. This may also provide the control signals 78 associated with controlling the state of the switches 59, delays 58, and/or phase shifters 56. For example, a first set of control signals 78-3 may control the phase shifter states such that each individual phase shifter 56 imparts a particular desired phase shift to one of the signals received from or transmitted by the respective antenna element 22. This permits the steering of the entire antenna array 10 to a particular desired direction, thereby increasing the overall available data rate that may be accomplished with the equipment. For example, the access unit 11 may receive a control message from the base station commanded to steer its array to a particular direction and/or circuits associated with the receiver 64 and/or decoder 66 may provide signal strength indication to the controller 72. The controller 72 in turn, periodically sets the values for the phase shifter 56.

Figure 1B:
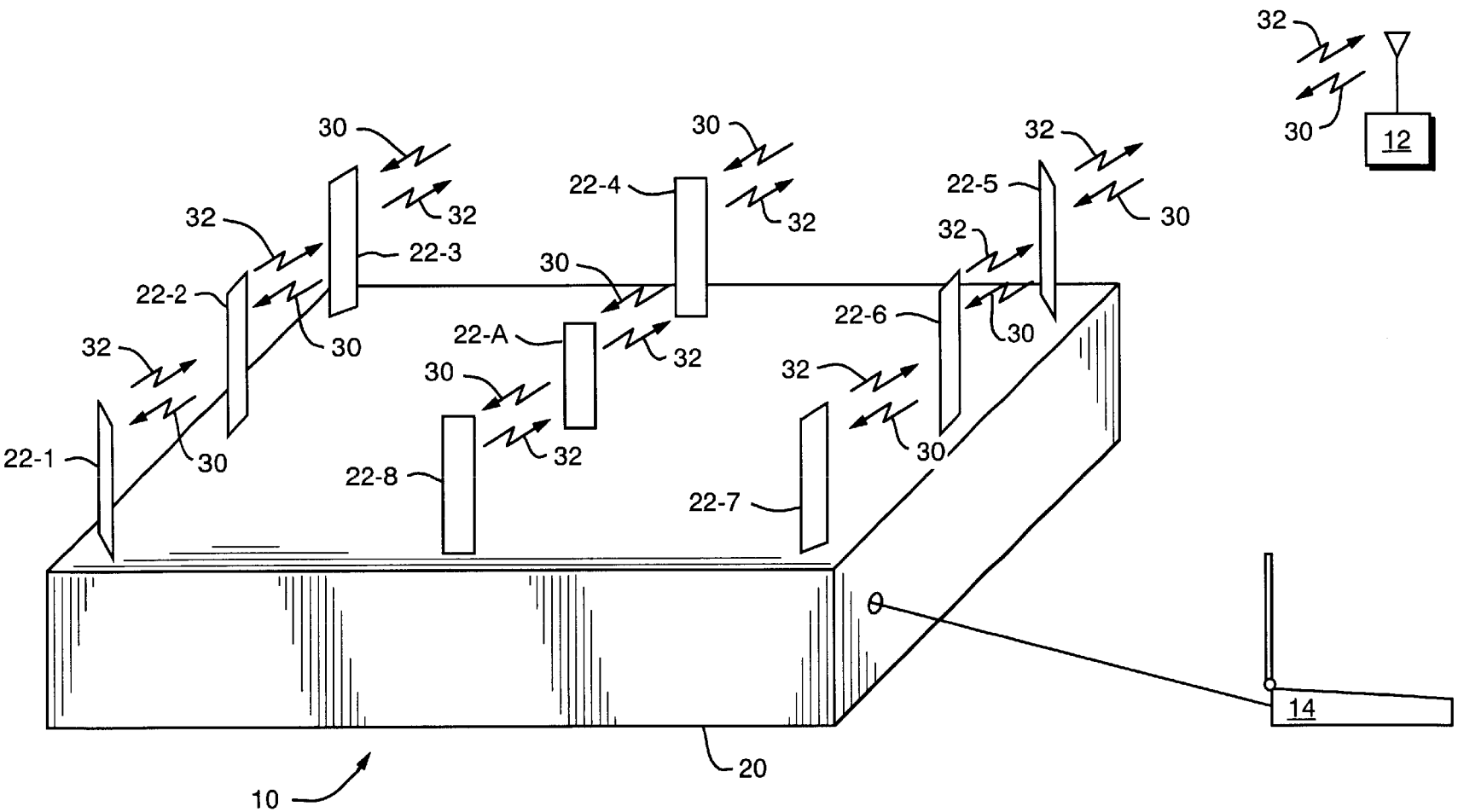
FIG. 1B illustrates another preferred configuration of an antenna apparatus used by a mobile subscriber unit in a cellular system according to this invention.
Figure 2B:
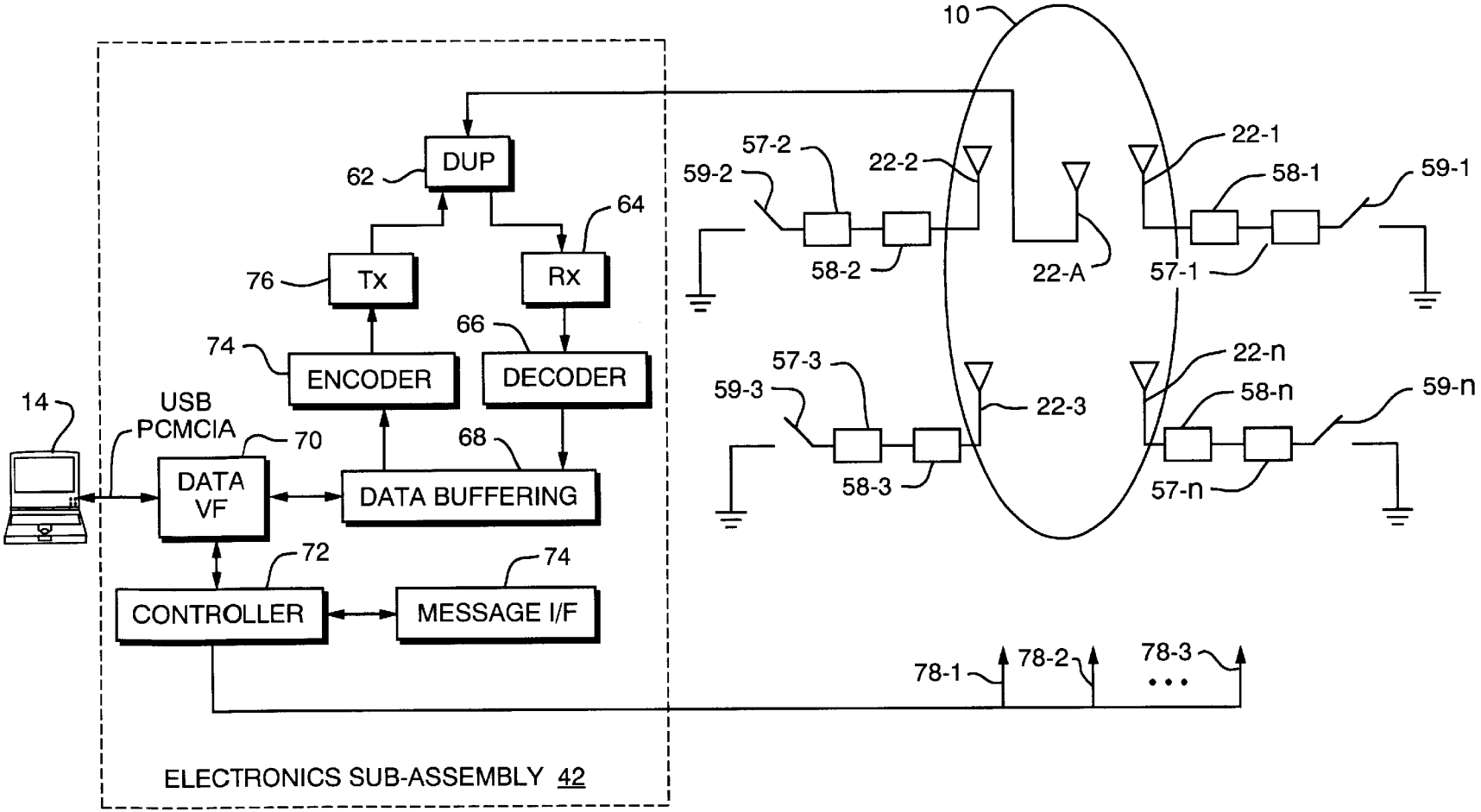
FIG. 2B is a system level diagram for the electronics which control the antenna array of FIG. 1B.
Figure 3:
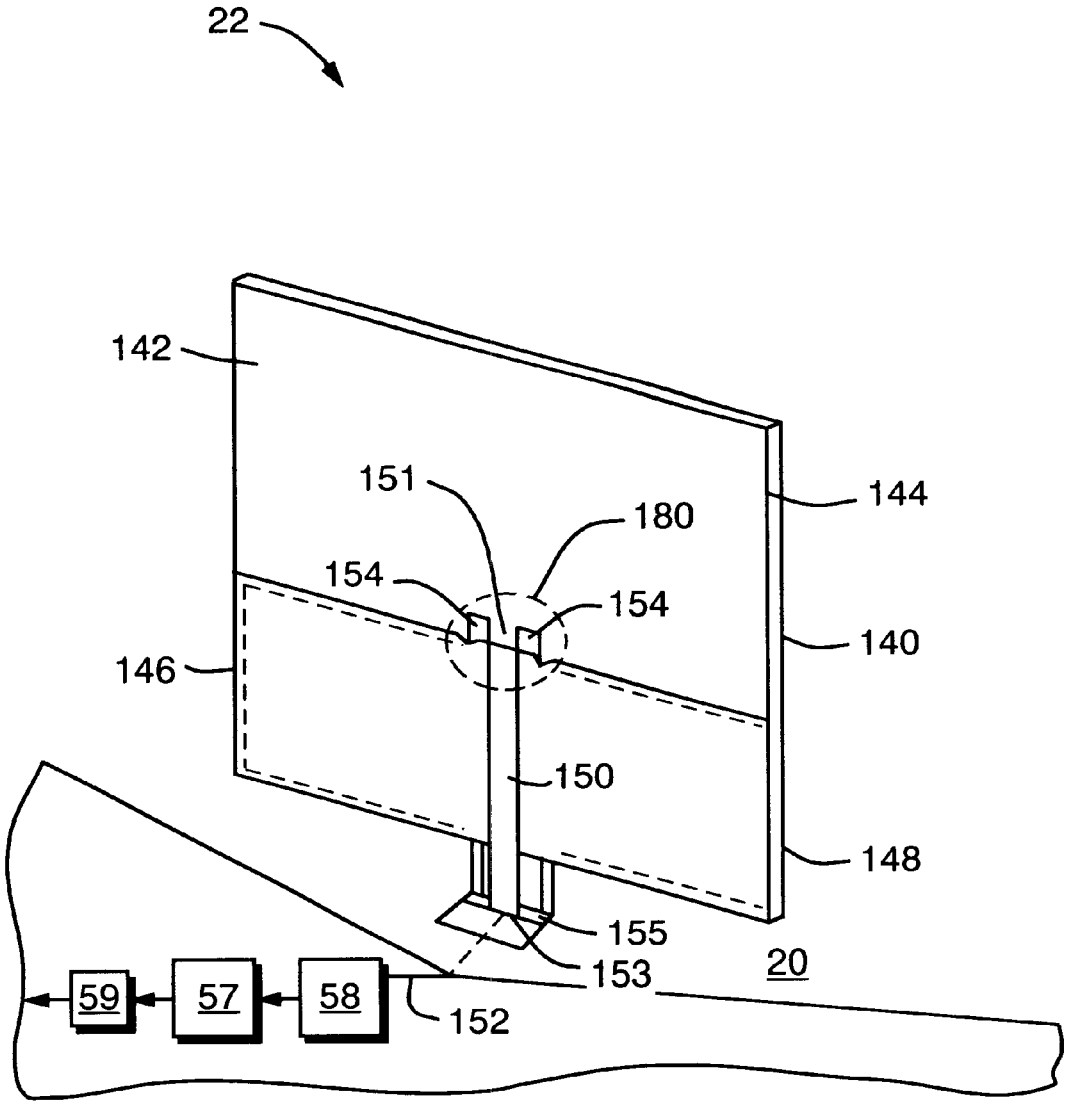
FIG. 3 is an isometric view of dipole antenna of the apparatus of FIG. 1.

Referring now to FIGS. 1B and 2B, there is shown an alternative arrangement for the antenna array 10 of the access unit 11. In this configuration, a single active antenna element 22-A is positioned in the middle of the ground plane 20 and is surrounded by a set of passive antenna elements 22-1, 22-2, 22-3, . . . , 22-N. (In FIG. 1B, there is shown eight passive antenna elements.) Here only the active antenna element 22-A is connected, directly through the duplexer filter 62, to the electronics subassembly 42. An associated delay 58, variable or lumped impedance element 57, and switch 59 is connected to a respective passive antenna element 22-1, 22-2, 22-3, . . . , 22-N.

In the arrangement shown in FIGS. 1B and 2B, the transmit/receive signals are communicated between the base station and the active antenna element 22-A. In turn, the active antenna element 22-A provides the signals to the electronics sub-assembly 42 or receives signals from the assembly 42. The passive antenna elements 22-1, 22-2, 22-3, . . . , 22-N either reflect the signals or direct the signals to the active antenna element 22-A. The controller 72 may provide control signals 78 to control the state of the delays 58, impedance elements 57, and switches 59.

Referring now to FIGS. 3, 4A, 4B, and 4C, each antenna element 22 includes a substrate 140 upon which a conductive planar element 142 is printed on one side 144 in an upper region of the substrate 140 and a conductive planar ground patch 146 is printed on an opposite side 148 in a lower region of the substrate 140. A feed strip 150 extends from the bottom of the conductive planar element and connects to a transmission line 152 at a bottom feed point 153 located at a bottom edge 155 of the substrate 140. The feed strip 150 includes an upward extension 151, and on either side of the upward extension 151 is a notch 154.

The conductive planar element 142 and the transmission line 152 are electrically isolated from the ground plane 20. The transmission line 152 is connected to the delay line 58 which in turn is connected to the lumped or variable impedance element 57 and the switch 59. The transmission line 152 provides a path for transmitted signals to and received signals from the antenna element 22. Instead of the delay line 58, a phase shifter can be connected to the antenna element 22. The phase shifter is independently adjustable to facilitate changing the phase of a signal transmitted from the antenna element 22.

Figure 4A:
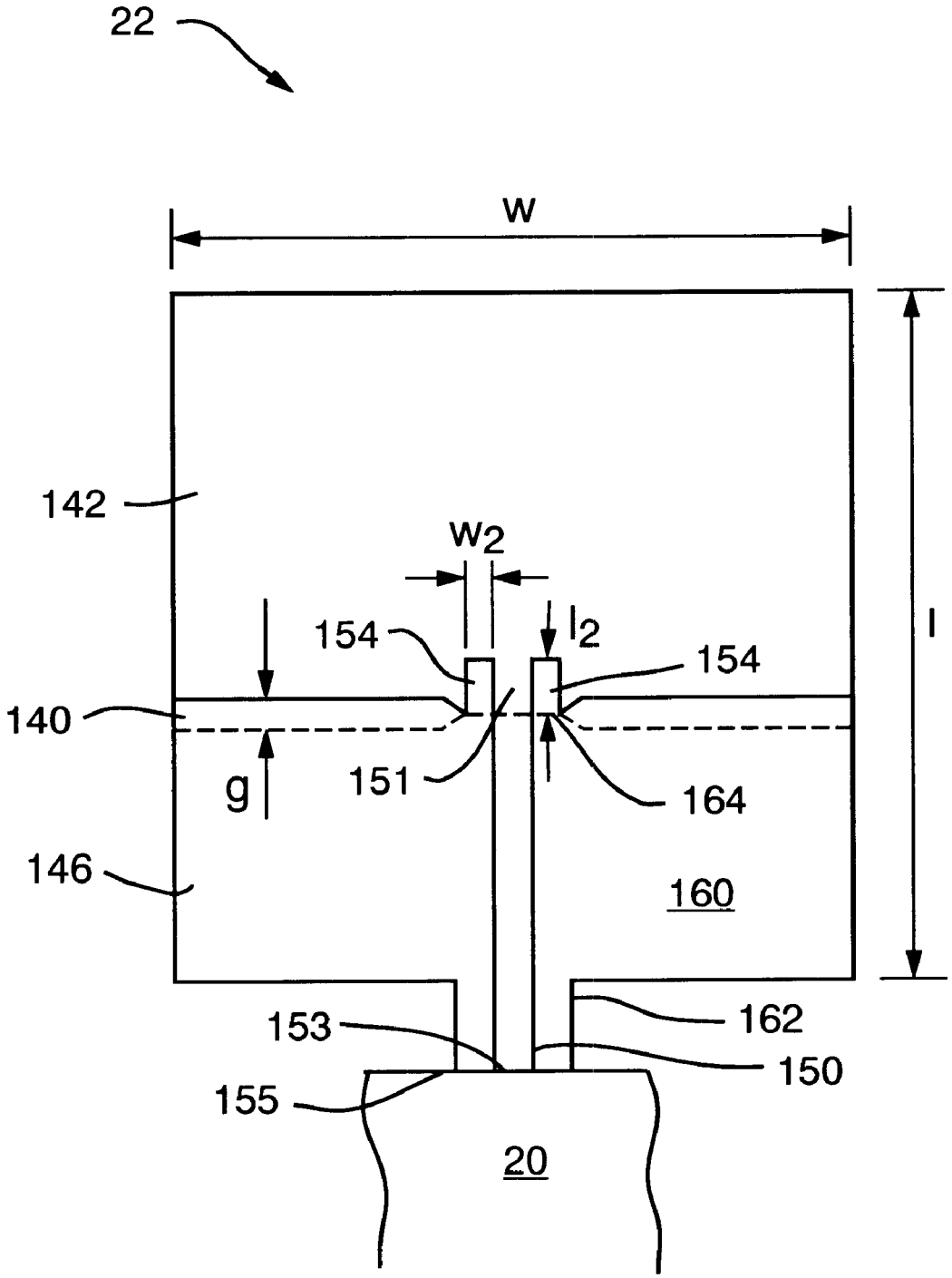
FIG. 4A is a view of both a conductive planar element and a conductive planar ground patch of the antenna of FIG. 3.
Figure 4B:
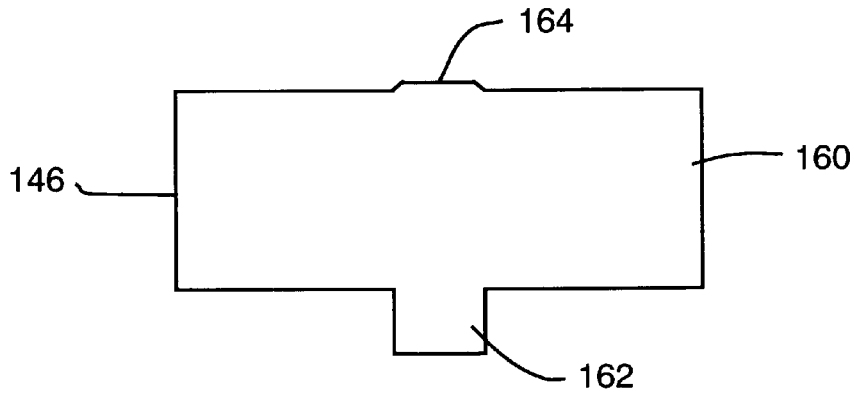
FIG. 4B is a view of the conductive planar ground patch of the dipole antenna of FIG. 3.
Figure 4C:
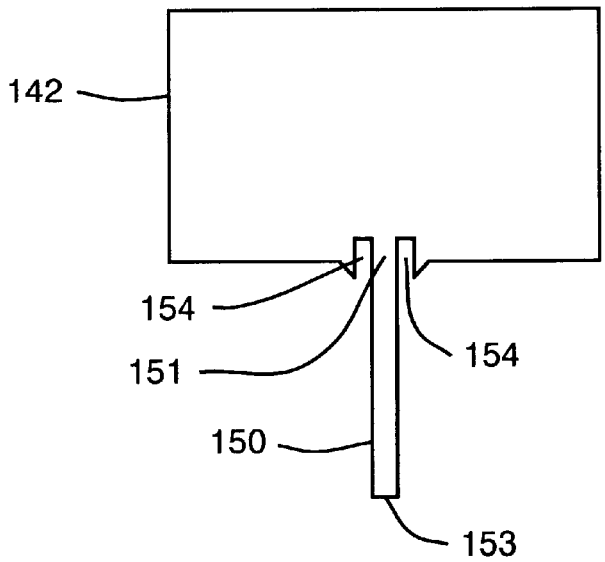
FIG. 4C is a view of the conductive planar element of the antenna of FIG. 3.

Referring now in particular to FIGS. 4A, 4B, and 4C, the conductive planar ground patch 146 includes an enlarged portion 160 connected to a narrower bottom end or base 162. The base 162 is in turn electrically connected to the ground plane 20 to couple the conductive planar ground patch 146 to the ground plane 20. The top edge of the conductive planar ground patch 146 is provided with an extension or snub 164. As an assembled unit, the snub 164 of the conductive planar ground patch is positioned just beneath the notches 154 of the conductive planar element 142.

The substrate 140 is made from a dielectric material, for example, from PCB materials such as polystyrene or Teflon. For applications in the PCS bandwidth (1850 Mhz to 1990 Mhz), the substrate 140 has a length, "1," of about a one-sixth wavelength of the transmitted/received signals, a width, "w," of about a one-sixth wavelength, and has a thickness of about 0.031 inch. The conductive planar element 142, the feed strip 150, and the conductive planar ground patch 146 are produced with printed circuit board techniques by depositing a respective layer to each of the sides 144 and 148 of the substrate 140 with a thickness of about 0.003 inch, and then photoetching the metallic layers into the desired shapes.

In use, the conductive planar element 142 is fed by the feed point 153 through the feed strip 150. However, because of capacitive coupling between the conductive planar element 142 and the conductive planar ground patch 146, there is a junction which provides a distributed feed point 180 (FIG. 3) in a middle region of the substrate 140. Thus, even though the feed strip 150 does not directly feed the conductive planar ground patch 146, the combination of the conductive planar element 142 and the conductive planar ground patch 146 acts as an unbalanced dipole antenna being fed at the distributed feed point 180. That is, some of the energy provided to the conductive planar element 142 splits off and is fed to the conductive planar ground patch 146.

Both the conductive planar element 142 and the conductive planar ground patch 146 are shaped as rectangles with the shorter sides of the rectangles being perpendicular to the ground plane 20. In this configuration, the width of the conductive planar element 142 and the width of the conductive planar ground patch 146 are large enough to enable the antenna element 22 to resonate over a broad bandwidth, for example, from about 1.85 Ghz to about 2 Ghz in PCS applications, Further, the antenna element 22 acts as a half-wave dipole antenna, even though the combined height of the conductive planar element 142 and that of the conductive planar ground patch 146 are no greater than one-sixth of a wavelength.

Figure 5:
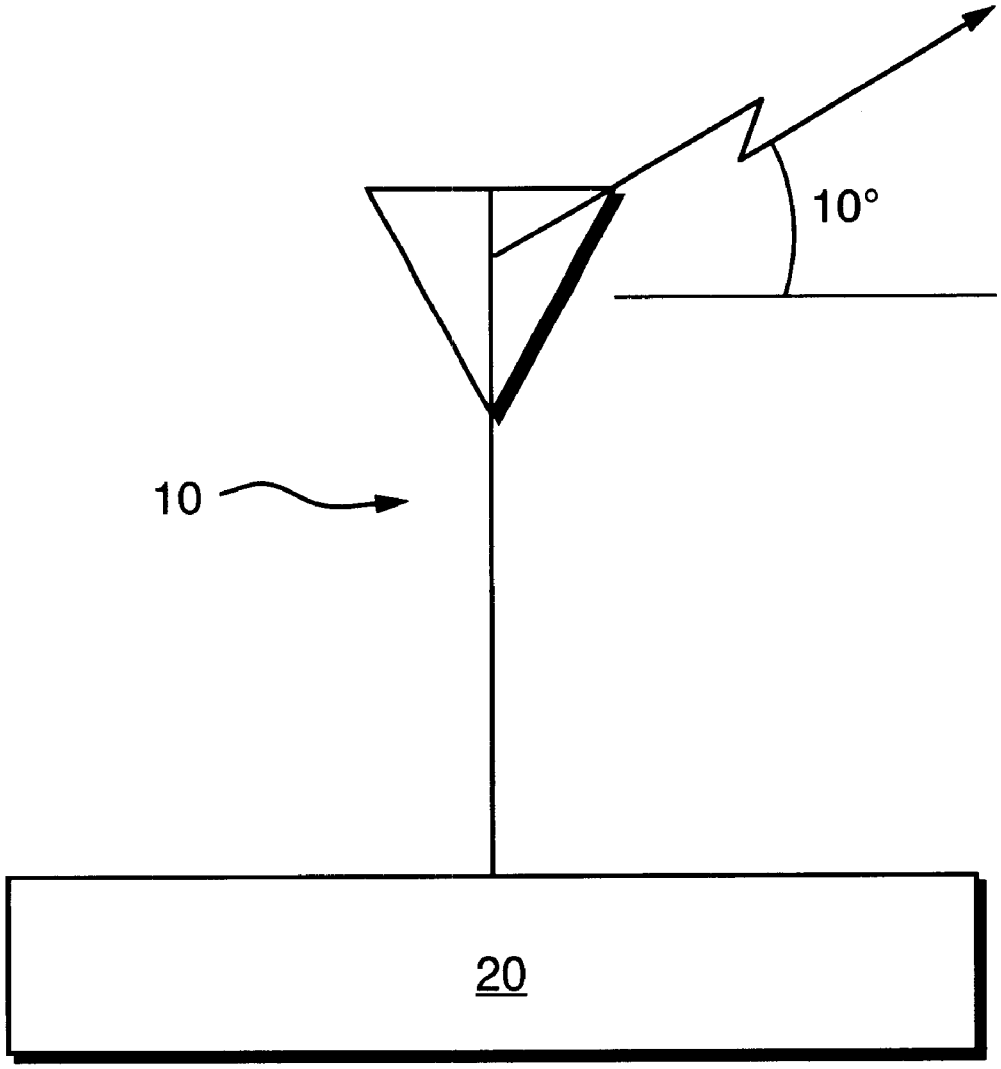
FIG. 5 illustrates a beam directed ten degrees above the horizon by an antenna element configured according to the invention.

The change of width of the conducting ground patch 146 from the enlarged portion 160 to the narrower base 162 allows a standing wave to be formed with a large current distribution at the distributed feed point 180 and along the upper edge of the enlarged portion 160, but a negligible current at the lower edge of the enlarged portion 160. This current distribution mirrors that on the conductive planar element 142. Togther they form a classic dipole current distribution, scarcely affected by the grounding at the base 162. Since the conductive planar element 142 and the conductive planar ground patch 146 function together as an unbalanced dipole antenna, the antenna array 10, as illustrated in FIG. 5, is capable of forming a beam with a peak beam strength rising no more than about 10° above the horizon.

Because of the low profile of the antenna element 22, the conductive planar ground patch 146 (acting as the bottom dipole element) wants to couple to the ground plane 20. As such, the antenna element 22 has a low impedance and consequently a high capacitance. To compensate for this high capacitance, a gap, "g," between the top edge of the conductive planar ground patch 146 and the bottom edge of the conductive planar element 142 (FIG. 4A) is adjusted to provide a desired capacitive loading to match the impedance of the antenna element 22 to the feed impedance.

In addition, the upward extension 151 and the notches 154 of the conductive planar element and the snub 164 of the conductive planar ground patch 146 interact as a coplanar waveguide, with the upper closed ends of the notches 154 short circuiting the waveguide. The length, "12," of the notches are varied to properly adjust the inductive loading of the antenna element 22. The length of the slightly radiating coplanar waveguide alters the radiation center, and reduces coupling to the ground plane 20. Alternatively, or additionally, the width, "W2," of the notches may be varied to alter the inductance of the antenna. The snub 164 serves as a smooth launching platform between the feed stip 150 and the extension 151.

While this invention has been particularly shown and described with references to preferred embodiments thereof, it will be understood by those skilled in the art that various changes in form and details may be made therein without departing from the scope of the invention encompassed by the appended claims.

What is claimed is:

1. A dipole antenna for use in a wireless communication subscriber unit, comprising:

a planar substrate made of dielectric material;

a conductive planar element disposed on one side of the substrate and located in an upper region of the one side and a feed strip connected thereto and extending from the conductive planar element to a bottom edge of the substrate and terminating at a bottom feed point; and a conductive planar ground patch disposed on an opposite side of the substrate and located in a lower region of the opposite side, the conductive planar ground patch including a bottom end for facilitating connecting the ground patch to a ground plane aligned substantially orthonormal to the substrate;

wherein capacitive coupling between the planar element and the planar ground patch creates a junction which provides an upper dipole feed in a midregion of the antenna such that the conductive planar element acts as one element of an unbalanced dipole antenna and the conductive planar ground patch acts as a second element of the unbalanced dipole antenna to form a beam which may be positionally directed along a horizon that is substantially parallel to the ground plane.

2. The dipole antenna of claim 1, wherein a bottom edge of the conductive planar element and a top edge of the conductive planar ground patch define a gap, and variations in the width of the gap alter the capacitance of the dipole antenna.

3. The dipole antenna of claim 1, wherein the connection between the conductive planar element and the feed strip is a connection between an upward extension of the feed strip and a bottom edge of the conductive planar element which defines a pair of notches with the upward extension of the feed strip being positioned between the notches.

4. The dipole antenna of claim 3, wherein the conductive ground patch includes a snub located in the middle of a top edge of the ground patch.

5. The dipole antenna of claim 4, wherein interaction between the snub, the upward extension, and the pair of notches provides a short-circuited coplanar waveguide.

6. The dipole antenna of claim 5, wherein variations in the length of the notches alters the inductance of the dipole antenna, and the location of the radiation centers.

7. The dipole antenna of claim 5, wherein variations in the width of the notches alters the inductance of the dipole antenna.

8. The dipole antenna of claim 1, wherein the conductive planar element has a rectangular shape with the shorter sides of the element being aligned substantially perpendicular to the bottom edge of the substrate.

9. The dipole antenna of claim 1, wherein the conductive planar ground patch has a rectangular shape with the shorter sides of the ground patch being aligned substantially perpendicular to the bottom edge of the substrate.

10. The dipole antenna of claim 1, wherein the dielectric material is made from PCB materials.

11. The dipole antenna of claim 1, wherein the dielectric material is made of polystyrene.

12. The dipole antenna of claim 1, wherein the dielectric material is made of Teflon.

13. The dipole antenna of claim 1, wherein the conductive planar element, the feed strip, and the conductive ground patch are made of copper.

14. The dipole antenna of claim 1, wherein the conductive planar element is connected to a phase shifter, the phase shifter being independently adjustable to affect the phase of respective signals transmitted from the dipole antenna.

15. The dipole antenna of claim 1, wherein the conductive planar element is connected to a delay line.

16. The dipole antenna of claim 1, wherein the conductive planar element is connected to a lumped impedance element.

17. The dipole antenna of claim 1, wherein the conductive planar element is connected to a variable impedance element.

18. The dipole antenna of claim 1, wherein the conductive planar element is connected to a switch.

19. The dipole antenna of claim 1, wherein the conductive planar element is connected to a delay line, a lumped impedance element, and a switch.

20. The dipole antenna of claim 1, wherein the conductive planar element is connected to a delay line, a variable impedance element, and a switch.

21. The dipole antenna of claim 1, wherein the bottom feed point is connected to a transmission line for transmitting signals to and receiving signals from the dipole antenna.

22. The dipole antenna of claim 1, wherein the width of the conductive planar element and the width of the conductive planar ground patch are sufficient to provide broadband performance.

23. The dipole antenna of claim 1, wherein the height of the conductive planar element and the height of the conductive planar ground patch are reduced to at least a one-sixth wavelength and the antenna acts as a half-wave dipole antenna.

24. The dipole antenna of claim 1, wherein the directed beam rises above the horizon at an angle of about 10°.

* * * * *